United States Patent [19]

Stanojevic

[11] Patent Number: 4,636,710

[45] Date of Patent: Jan. 13, 1987

[54] STACKED BANDGAP VOLTAGE REFERENCE

[76] Inventor: Silvo Stanojevic, 641 Clauser Dr., Milpitas, Calif. 95035

[21] Appl. No.: 787,194

[22] Filed: Oct. 15, 1985

[51] Int. Cl.[4] ..... G05F 1/575

[52] U.S. Cl. ..... 323/280; 323/281; 323/314

[58] Field of Search ..... 323/313, 314, 907, 280, 323/281

[56] References Cited

U.S. PATENT DOCUMENTS

| | | | |
|---|---|---|---|
| Re. 30,586 | 4/1981 | Brokaw | 323/314 |
| 3,893,018 | 7/1975 | Marley | 323/313 |
| 4,277,739 | 7/1981 | Priel | 323/314 |
| 4,525,663 | 6/1985 | Henry | 323/280 |

*Primary Examiner*—William M. Beha, Jr.

[57] ABSTRACT

A pair of ratioed emitter size transistors is operated to produce a $\Delta V_{BE}$. A second pair of transistors is coupled in series with the first pair and matched therewith so as to produce $2\Delta V_{BE}$. This differential voltage appears across a resistor coupled in series with the low current density transistors. This circuit combination produces a current that is proportional to absolute temperature (PTAT) and which is passed through a suitable value resistor to develop a PTAT voltage. This voltage is combined with a negative temperature coefficient voltage produced by forward biased series connected diodes so as to produce a combined voltage that is a multiple of the semiconductor bandgap extrapolated to absolute zero. The diodes are operated at very low current levels so that the circuit requires a very low operating current.

5 Claims, 4 Drawing Figures

STACKED BANDGAP VOLTAGE REFERENCE

BACKGROUND OF THE INVENTION

The invention relates to voltage regulators and specifically relates to an improved voltage reference circuit used in a voltage regulator. A basic stacked bandgap reference is found in the Brokaw U.S. Pat. No. Re. 30,586 patent reissued from U.S. Pat. No. 3,887,863 which originally issued June 3, 1975. Here a pair of ratioed current density transistors have their bases coupled together and are biased so that the transistor collectors are at the same potential. The differential base to emitter voltage ($\Delta V_{BE}$) appears across a resistor in series with the emitter of the low current density transistor. The combined emitter currents of the two transistors are returned to ground through a common stacking resistor. The voltage across the stacking resistor therefore is proportional to absolute temperature (PTAT). When this voltage is combined with the $V_{BE}$ of the high current density transistor, and the combination made close to the bandgap of silicon extrapolated to absolute zero (about 1.25 volts), a temperature compensated reference voltage $V_{REF}$ is achieved.

When this reference voltage is used to establish the regulation level in a regulated power supply, the output voltage of the regulator will be substantially independent of temperature. Typically the regulator will include a voltage divider connected across the output terminals and it has a tap operating at $V_{REF}$. The regulator also includes a current pass device connected between the power input terminal and the output terminal. The pass device has its conductivity controlled so that the divider tap is at $V_{REF}$. Such a divider is desirably stiff so that considerable quiescent current is required. Quiescent current is defined as that current flowing to ground in the regulator circuit and which does not contribute to current flow in the load. Thus, quiescent current is wasted and it is desirable to reduce or eliminate it, particularly in battery operated equipment.

SUMMARY OF THE INVENTION

It is an object of the invention to provide a temperature stabilized stacked bandgap voltage reference that draws very little current.

It is a further object of the invention to provide a voltage regulator having a low quiescent current.

It is a still further object of the invention to provide a low quiescent current voltage regulator that has a low dropout voltage.

These and other objects are achieved in a stacked bandgap reference circuit based upon a pair of transistors having ratioed current densities and their bases connected together. The low current density transistor has is emitter coupled through a resistor and a forward biased matched diode to the stacking resistor. The high density transistor has its emitter returned to the stacking resistor through a matched forward biased diode. Thus, twice $\Delta V_{BE}$ appears across the resistor coupled to the low density transistor emitter. The diode in the low density transistor emitter forms a unity gain current mirror with a transistor that has its collector coupled to the bases of the transistor pair and is returned to the reference output terminal through a pair of series connected forward biased diodes matched to the high density transistor. The collectors of the transistor pair are returned to the reference output terminal by way of a unity gain current mirror load configured so that the collector currents in the pair are matched. In this case the transistor emitters are ratioed in area so as to achieve the desired current density ratio. Alternatively, the transistor pair can be made up of matched transistors and the current mirror load ratioed to provide the current density ratio. Furthermore, a combination of current and emitter area ratios can be employed to achieve the desired current density ratio. The output of the current mirror load is coupled to the input of a high gain amplifier the output of which provides the reference output terminal. It can be seen that the stacking resistor will pass three equal valued currents including the two currents flowing in the transistor pair and the mirrored current of the low current density transistor. Since these currents are related to $\Delta V_{BE}$ they are PTAT. Therefore, the voltage across the stacking resistor is also PTAT. This voltage is in series with four forward biased diodes coupled to the reference output terminal. The diode voltage drops have a negative temperature coefficient. If the voltage across the stacking resistor is made equal to the sum of the forward biased diode drops the temperature coefficients will cancel and the reference potential will be independent of temperature. If the combined voltages at 300° K. is made equal to 5 volts a substantially temperature stabilized voltage will appear at the reference output terminal. This can be done by trimming the stacking resistor to produce a 5 volt output.

DESCRIPTION OF THE PRIOR ART

Figure 1:
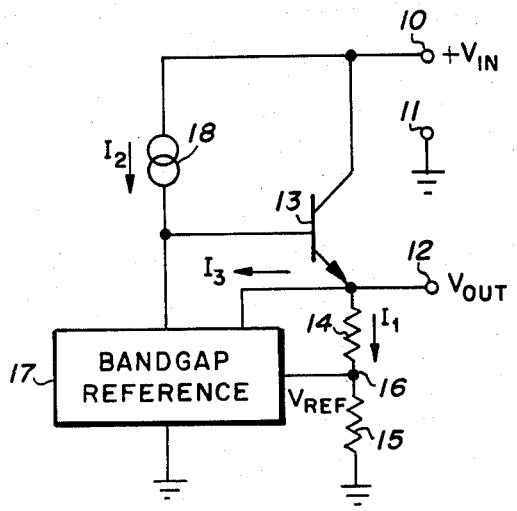
Fig 1 (PRIOR ART)
FIG. 1 is a simplified schematic design of the prior art.

FIG. 1 shows a typical prior art temperature compensated reference source. An input supply is connected + to terminal 10 and − to ground terminal 11. The output reference $V_{OUT}$ appears at terminal 12. A pass transistor 13 couples the $+V_{IN}$ to terminal 12 and its conduction is modulated to provide the desired output voltage control. Resistors 14 and 15 form a voltage divider coupled from terminal 12 to ground and conducts $I_1$. Tap 16 will be at a voltage that is a fraction of $V_{OUT}$. A bandgap reference 17 is supplied with current $I_2$ from source 18 and acts to produce a temperature stable $V_{REF}$. The bandgap reference compares its internally generated $V_{REF}$ with the potential at tap 16 and produces an output that modulates the conduction of transistor 13 until the potential at tap 16 equals $V_{REF}$. The actual voltage at terminal 12 will be a multiple of $V_{REF}$. The value of the multiple will be determined by the voltage divider resistor ratio. If resistor 14 is zero, $V_{OUT}$ will be at the typical bandgap reference of about 1.25 volts. As resistor 14 is increased, $V_{OUT}$ can be at any higher voltage. The bandgap reference is also supplied with a current $I_3$ from output terminal 12. In this circuit the quiescent current is the sum of $I_1$, $I_2$ and $I_3$.

DESCRIPTION OF THE INVENTION

Figure 2:
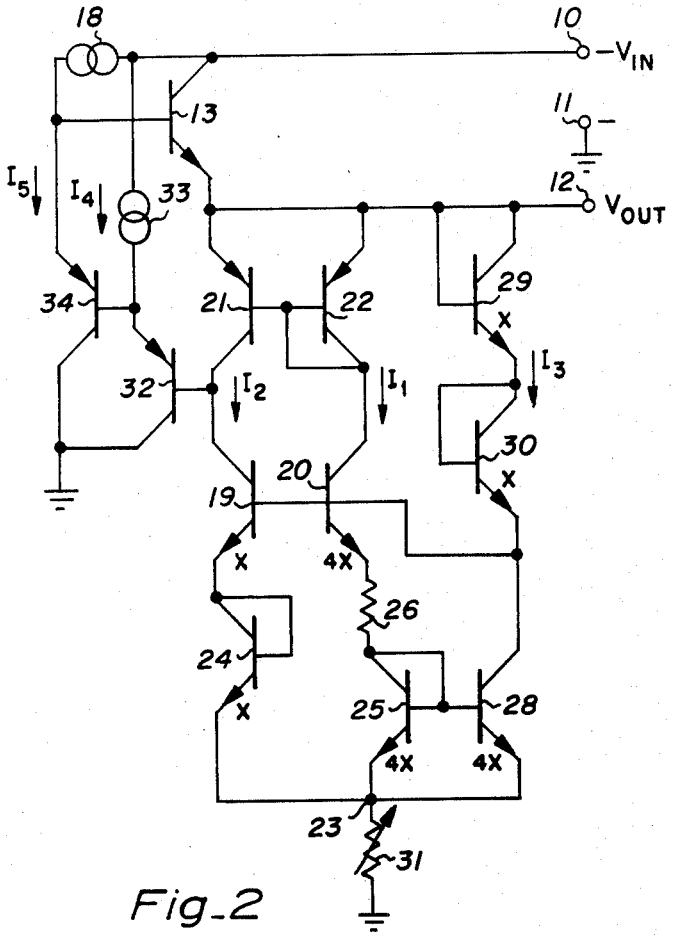
FIG. 2 is a schematic diagram of a stacked 5 volt reference circuit.

FIG. 2 is a schematic diagram of the basic circuit of the invention. Where the parts function as do those in FIG. 1 the same numbers are used. In the following discussion, the transistor base currents will be neglected. The condition is realistic because the typical transistor base current is a very small fraction of the collector current.

The heart of the circuit is a pair of transistors 19 and 20 which have their bases connected together. Transistor 20 is shown having four times the area of transistor 19. If these transistors are forced to conduct equally, transistor 19 will have a current density of four times that of transistor 20. Transistors 21 and 22 form a unity gain current mirror that forces equal conduction in transistors 19 and 20. This means that the $V_{BE}$ of transistor 19 will exceed that of transistor 20 by $\Delta V_{BE}$ which is:

$$\Delta V_{BE} = \frac{kT}{q} \ln \frac{J19}{J20}$$

where:

k is Boltzmann's constant

T is absolute temperature q is the charge of an electron

J19/J20 is the current density ratio of transistors 19 and 20

At 300° K. this differential voltage is about 36 millivolts for the transistor pair. It will be noted that transistor 19 is coupled by an equal area diode connected transistor 24 to node 23. Transistor 20 is coupled by way of resistor 26 and an equal area diode connected transistor 25 to node 23. Thus, it is clear that $2\Delta V_{BE}$ will appear across resistor 26. At 300° K. this is about 72 millivolts and is PTAT. Thus, $I_1$ and its mirrored version $I_2$ is PTAT.

Transistor 28 forms a unity gain current mirror with transistor 25 and this produces $I_3$ which also equals $I_1$ and flows in diode connected transistors 29 and 30. Thus, the current at node 23 is the sum of $I_1$, $I_2$, and $I_3$. This PTAT current flows in resistor 31 so that the potential at node 23 will be a linear function of absolute temperature and it will extrapolate to zero at absolute zero.

The collector of transistor 28 is coupled to the bases of transistors 19 and 20 to create a negative feedback loop that stabilizes the circuit operation. The bases of transistors 19 and 20 are forced to a level at which $2\Delta V_{BE}$ appears across resistor 26. This establishes the value of $I_1$.

Transistor 32 is connected as an emitter follower having a current source 33 load and has its input connected to the collector of transistor 21 which is the current mirror load single ended output. This emitter follower drives the input of emitter follower transistor 34 which has current source 18 as its load element. Transistor 34 in turn drives pass transistor 13. Thus, transistors 32, 34 and 13 form a high gain current gain amplifier that provides negative feedback stabilization of the potential of terminal 12.

It can be seen that the potential at terminal 12 will be four diodes above that at node 23. This includes the $V_{BE}$ of transistor 19 and the three series connected diodes 24, 29 and 30. Since these diode drops have a negative temperature coefficient and node 23 is PTAT their temperature effects will oppose each other. If the value of resistor 31 is trimmed to produce 5 volts at terminal 12 at 300° K., the output voltage will remain essentially at 5 volts as the temperature is varied.

If $I_1$, $I_2$ and $I_3$ are all made equal to one microampere, the value of resistor 26 is about 72k ohms and the value of resistor 31 will be about a megohm. At this current level the diode drops will be close to 0.5 volt. It will be noted that this current level is at the lower conduction extreme for the devices involved. If $I_4$ and $I_5$ are also made about one microampere, the total circuit quiescent current is only five microamperes. The output capability at terminal 12 will be on the order of 200 microamperes (assuming that the Beta of transistor 13 is about 200). Thus, the quiescent current is only about 2½% of maximum output.

Figure 3:
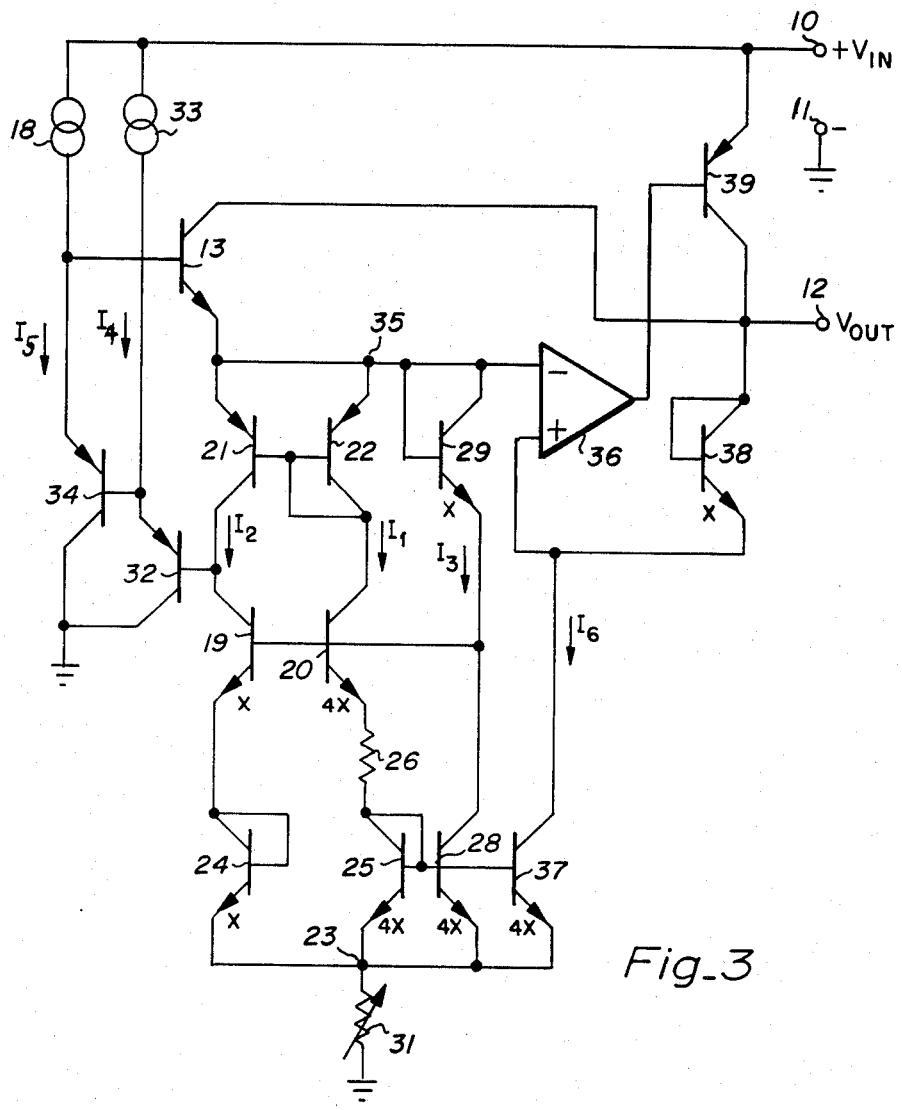
FIG. 3 is a schematic of a low drop out 5 volt voltage regulator.

FIG. 3 is a schematic diagram of a low dropout voltage regulator circuit employing the invention. When the parts operate in a manner similar to the FIG. 2 circuit, the same designations are used. As before, transistors 19 and 20, along with transistors 24 and 25, are ratioed to develop $2\Delta V_{BE}$ across resistor 26 and load transistors 21 and 22 force equal currents in transistors 19 and 20. Diodes 24 and 25 respectively conduct the currents in transistors 19 and 20 and act to introduce a $V_{BE}$ level shift. Transistor 25 forms a unity gain current mirror with transistor 28 so that the current through transistor 29 matches that flowing in transistors 19 and 20. The collector of transistor 28 is coupled to the bases of transistors 19 and 20 thereby stabilizing the circuit so that $2\Delta V_{BE}$ appears across resistor 26 and thereby establishes the value of $I_1$. Transistor 13, which is driven from the collector of transistor 19 by way of emitter follower transistors 32 and 34, produces a $V_{REF}$ level at its emitter equal to the potential at node 23 plus three diodes.

The $V_{REF}$ node 35 is coupled to the inverting input of op amp 36. The noninverting input of op amp 36 is provided by transistor 37 which is connected as a unity gain current mirror with transistor 25. Thus, $I_6$, which flows in diode connected transistor 38, is equal to $I_1$. This connection operates the noninverting input of op amp 36 at one diode below output terminal 12.

A PNP pass transistor 39 is coupled between $V_{IN}$ terminal 10 and output terminal 12. The base of transistor 39 is driven from the output of op amp 36. In operation the conduction of pass transistor 39 is varied by op amp 36 until the noninverting op amp input is equal to $V_{REF}$ at node 35. This places the two inputs at one diode below the output terminal 12 potential. Thus, the potential at terminal 12 will be equal to the potential at node 23 plus the diode drops across transistors 24, 19, 29 and 38. Since these devices all conduct the same currents due to the current mirror actions, and are of the same size, four 0.5 volt diode drops will combine with the 3 volt level at node 23 to produce a 5 volt output.

As in FIG. 3 circuit resistor 31 is trimmed to produce the 3 volt level at node 23. If resistor 26 is made about 100k ohms, $I_1$ and hence $I_2$, $I_3$ and $I_6$ will each be about ¾ microampere so that the total current at node 23 will be close to 3 microamperes.

If resistor 31 is normally one megohm the 3 volt level at node 23 is achieved. The main advantage of the FIG. 3 circuit is its low dropout voltage. That is, the circuit will be functional in the situation where $V_{IN}$ falls to a small fraction of a volt about $V_{OUT}$. This is due to the use of a PNP pass transistor 39.

Figure 4:
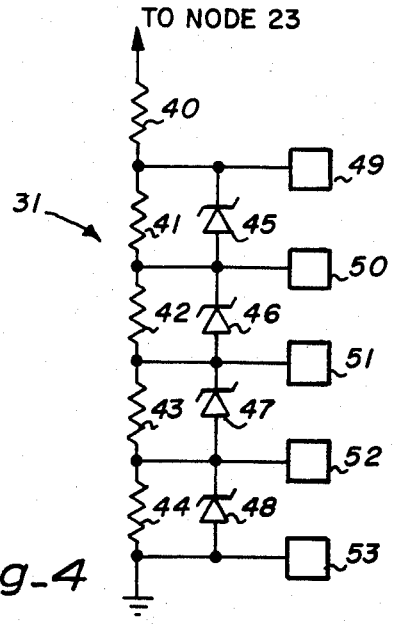
FIG. 4 is a schematic diagram of the stacking resistor detail of the circuit of FIG. 3.

FIG. 4 shows an IC construction form suitable for resistor 31 of FIGS. 2 and 3. The resistance is made up of five series connected resistors 40–44. Resistors 41–44 are each shunted by a zener diode 45–48 and each zener diode has its terminals connected to IC pads 49–53. The zener diodes are normally reverse biased below their breakdown voltage. Thus, they do not pass enough current to produce any resistor shunting. By the use of test probes (not shown) a zapping power supply can be connected to any selected zener diode which can be zapped. This means that an excessive current is passed through the zener diode for a brief period of time which destroys the diode and causes it to become a short circuit. Thus, in this zener zapping operation any one, or combination, of resistors 41–44 can be selectively shorted after the IC is completed. This permits the completed circuit to be trimmed to a specified output voltage.

If desired, the resistors can be chosen to have digitally weighted values. This provides the user with any one of 16 resistor values in equal steps while using only 5 resistors as shown. For example, if a nominal one megohm resistor is desired, the following values can be employed:

| RESISTOR | VALUE (k ohms) |
|---|---|
| 40 | 887.5 |
| 41 | 17.67 |
| 42 | 35.34 |
| 43 | 70.68 |
| 44 | 141.36 |

The maximum resistance is 1.1525 megohms with all diodes intact and the minimum value is 887.5k ohms with all diodes zapped. The incremental steps between the two extremes are of equal value. Pads 49 and 50 control the LSB resistor value while pads 52 and 53 control the MSB value. While the resistor values are given to four places, lesser accuracy values can be employed. In operation the IC is manufactured and the output voltage measured. Then the required resistor value is determined and the appropriate zeners are zapped to produce that level nearest to the desired value. If the original IC can be manufactured to with ±10% of the desired value, this trim scheme produces a final value of ±0.5%.

The invention has been described and two embodiments detailed. When a person skilled in the art reads the foregoing description, alternatives and equivalents, within the spirit and intent of the invention, will be apparent. Accordingly, it is intended that the scope of the invention be limited only by the following claims.

I claim:

1. A voltage reference circuit having a reference node and first and second supply rails connectable to a source of operating power, said circuit comprising:

first and second transistor means having their bases coupled together and operated so that said first transistor has a higher emitter current density thereby developing a $\Delta V_{BE}$ between said first and second transistor means;

third transistor means diode connected and coupled between the emitter of said first transistor and a first circuit node;

fourth transistor means diode connected and coupled in series with a first resistor between the emitter of said second transistor and said first circuit node whereby twice $\Delta V_{BE}$ appears across said first resistor;

first current mirror means coupled between the collectors of said first and second transistor means and said reference node whereby said collector of said first transistor provides a single ended load output node;

amplifier means, coupled between said first supply rail and said reference node, and responsive to the potential of said load output node for forcing said reference node to operate about one diode higher than the potential at said load output node;

fifth transistor means having its base-emitter circuit coupled across said fourth transistor means to form a second current mirror therewith and a collector connected to said bases of said first and second transistors;

sixth and seventh transistor means diode connected and coupled to forward conduct between said reference node and said collector of said fifth transistor means; and a second resistor coupled between said first circuit node and said second supply rail, said second resistor having a value that when conducting the currents flowing in said first, second and fifth transistors at about 300° K. produces a potential that is slightly higher than the combined drops across said first transistor emitter electrodes in series with said third, sixth and seventh transistors to produce a reference voltage on the order of five volts.

2. The circuit of claim 1 wherein said third transistor means is matched to said first transistor means and said fourth transistor means is matched to said second transistor means.

3. The circuit of claim 2 wherein said sixth and seventh transistor means are also matched to said first transistor means.

4. The circuit of claim 3 wherein said fifth transistor means is matched to said second transistor means.

5. The circuit of claim 1 wherein said first current mirror has unity current gain so that the currents in said first and second transistor means and said second transistor means has a larger emitter area than said first transistor means whereby said first transistor means operates at higher current density.

* * * * *